US007195662B2

(12) United States Patent
Dobesberger et al.

(10) Patent No.: US 7,195,662 B2
(45) Date of Patent: Mar. 27, 2007

(54) DEVICE AND PROCESS FOR PRODUCING METAL FOAM

(75) Inventors: Franz Dobesberger, Schwarzenau (AT); Herbert Flankl, Perg (AT); Dietmar Leitlmeier, Schleissheim/Wels (AT); Alois Birgmann, Moosdorf (AT)

(73) Assignee: Huette Klein-Reichenbach Gesellschaft MBH, Schwarzenau (AT)

( * ) Notice: Subject to any disclaimer, the term of this patent is extended or adjusted under 35 U.S.C. 154(b) by 566 days.

(21) Appl. No.: 10/170,538

(22) Filed: Jun. 14, 2002

(65) Prior Publication Data

US 2003/0047036 A1 Mar. 13, 2003

(30) Foreign Application Priority Data

Jun. 15, 2001 (AT) ..... A 935/2001
Jun. 15, 2001 (AT) ..... A 936/2001
Apr. 22, 2002 (AT) ..... A 621/2002

(51) Int. Cl.
*C22B 5/20* (2006.01)
*C21C 5/48* (2006.01)

(52) U.S. Cl. ..... 75/415; 266/217; 266/220

(58) Field of Classification Search ..... 266/217, 266/220; 75/415; 164/79
See application file for complete search history.

(56) References Cited

U.S. PATENT DOCUMENTS 4,973,358 A * 11/1990 Jin et al. ..... 75/415
5,112,697 A 5/1992 Jin et al.
5,186,886 A 2/1993 Zerinvary et al.
5,221,324 A 6/1993 Jin et al.
5,281,251 A 1/1994 Kenny et al.
5,334,236 A 8/1994 Sang et al.

FOREIGN PATENT DOCUMENTS

| | | |
|---|---|---|
| CA | 2147377 | 5/1994 |
| CA | 2378825 | 1/2001 |
| DE | 4326982 | 2/1995 |
| EP | 0483184 | 5/1992 |
| EP | 0544291 | 6/1993 |
| EP | 0545957 | 8/1996 |
| JP | 2000-263194 | 9/2000 |
| WO | 91/01387 | 2/1991 |
| WO | 91/03578 | 3/1991 |

OTHER PUBLICATIONS

English Language Abstract of EP 0 544 291, Jun. 1993.
English Language Abstract of DE 43 26 982, Feb. 1995.

(Continued)

*Primary Examiner*—Scott Kastler
(74) *Attorney, Agent, or Firm*—Greenblum & Bernstein, P.L.C.

(57) ABSTRACT

A device for feeding gas in a melt of foamable metal by means of at least one pipe for producing metal foam. The gas insertion pipe projects inwardly into the melt and at the projecting end has a gas outlet having a cross section of 0.006 to 0.2 $mm^2$ and a pipe face area of less than 4.0 $mm^2$. A flowable metal foam has gas bubbles defined by walls of a liquid metal matrix with solid reinforcing particles, and the diameter of the largest gas bubbles divided by that of the smallest gas bubbles is less than 2.5.

44 Claims, 2 Drawing Sheets

OTHER PUBLICATIONS

English Language Abstract of JP 2000-263194, Sep. 2000.

Miyoshi T et al: "Aluminum foam, 'Alporas': the production process, properties and applications" Porous and Cellular Materials for Structural Applications Materials Research Society Symposium Proceedings V 521 1998, Materials, Dec. 1998, Research Society, Pittsburg, PA, US, Bd. 521, 1998, pp. 133-137, ISSN: 0272-9172.

Nadler, J.H. (Georgia Inst of Technology, Atlanta, GA, USA) et al: "Aluminum hollow sphere processing." Materials Science Forum V 331 (1) 2000 p. 495-500 ISSN: 0255-5476, Dec. 2000.

* cited by examiner

DEVICE AND PROCESS FOR PRODUCING METAL FOAM

CROSS-REFERENCE TO RELATED APPLICATIONS

The present application claims priority under 35 U.S.C. § 119 of Austrian Patent Application No. 935/2001, filed on Jun. 15, 2001, of Austrian Patent Application No. 936/2001, filed on Jun. 15, 2001, and of Austrian Patent Application No. 621/2002, filed on Apr. 22, 2002. The entire disclosures of these three applications are expressly incorporated herein by reference.

BACKGROUND OF THE INVENTION

1. Field of the Invention

The present invention relates to a device for feeding gas into a melt of foamable metal by means of a pipe to produce metal foam.

The invention further relates to a process for producing metal foam by blowing gas into a foamable metal melt.

2. Discussion of Background Information

Materials having new property profiles are increasingly required in innovative technology. Metal foam represents such a material. On the one hand, in comparison with a solid material, it has a substantially lower specific gravity, and on the other hand it shows different mechanical properties and a completely different material behavior.

Various processes are known for producing metal foam materials. For example, substances can be added to a metal melt and distributed therein, which substances disintegrate at the given melting temperature of the metal phase with concomitant gas development. The forming or formed gas bubbles are thereby frozen within the melt and a foam part is produced in this way.

Foaming processes are further known in which gas is fed beneath the surface of a melted, foamable metal, a so-called liquid composite material, and thereby a metal foam is produced. For example, such a continuous foaming process is known from WO 91/01387 and EP 483184 B1.

According to EP 545957 B1 an introduction of gas into a liquid metal can also be effected by means of a vortex. As a result thereof, pores of different diameters are contained in the foam material formed and solidified in this manner, resulting in a scarcely reproducible material behavior. An adjustment of the pore size or size distribution in the foam part is not thereby possible to a sufficient extent.

According to U.S. Pat. No. 5,281,251, gas is introduced into a melt by means of a feed device which has a blunger form and features gas discharge points on the outside blade ends. A similar embodiment of the gas introduction means or a vibrating or oscillating nozzle is disclosed in U.S. Pat. No. 5,334,236.

In order to achieve an efficient foam formation, it has also been suggested (EP-544291 A1) to add the gas to the liquid metal via a plurality of nozzles in the form of an oscillating nozzle comb or by means of a vertical nozzle with a rotating, propeller-like agitator above it for swirling the gas bubbles.

The entire disclosures of all of the above-referenced documents are expressly incorporated herein by reference.

All of the known devices for producing metal foam by blowing gas into a melt are disadvantageous in that they have in common that pores or gas bubbles with large differences in dimensions are formed and that their size and size distribution cannot be controlled to the desired extent.

This often results in undesirable relatively high specific gravities and insufficiently reproducible material behavior of the metal foam material.

SUMMARY OF THE INVENTION

The present invention provides a device of the type mentioned at the outset by means of which gas in the form of pores or bubbles of approximately identical volume which are adjustable in size can be fed into the melt. The present invention also provides a process for producing a desired metal foam.

According to the invention, in a device of the type mentioned above the gas feed pipe projects inwardly into the melt and at the projecting end has a gas outlet cross section of a size of about 0.006 to about 0.2 $mm^2$ and a pipe face area of less than about 4.0 $mm^2$.

The advantages achieved with the invention can essentially be seen in that stable bubble separation criteria are established at the gas feed pipe for the formation of pores with a predetermined size.

Tests have shown that if gas is fed into a foamable metal through a bore in a nozzle plate according to the state of the art, a bubble is formed, and subsequently the bubble adhesion area around the bore increases. In practice the time of the separation and the size of the bubble formed on the nozzle plate do not follow a strict and narrow law, so that metal foam formed in this manner contains bubbles of widely varying diameters. If, e.g., two or more bores are provided in the nozzle plate for blowing gas into the liquid metal, the increase of the respective bubble adhesion area on the plate surface can progress so far that the individual bubbles combine to form one oversized bubble, which counteracts the desired foam formation. As mentioned at the outset, attempts have already been made to achieve a defined gas bubble separation from the nozzle or a division of large gas bubbles by a relative motion of the gas feed opening within the metal or by swirling, but this has not produced the desired effect to a sufficient extent.

Due to the geometric design of the gas feed pipe according to the invention, for the first time desired and stable gas separation criteria can be established in the melt, which criteria produce essentially an equally high volume of individual bubbles and of the pores of the metal foam formed therefrom.

The device can advantageously be designed such that the length by which the outlet opening of the gas feed pipe projects into the melt is at least about 5 times, preferably at least about 10 times, the value of the largest internal dimension of the outlet opening. Particularly effective stable separation criteria of the bubbles in the melt can thereby be achieved.

If the gas feed pipe has a round gas outlet opening and pipe face edge or a circular pipe face area, particularly economical pipe face embodiments for controlling the gas bubble size can be achieved.

In order to achieve a high stability with a small face area of the gas feed pipe, as well as a high durability of the device in the foaming operation, it can be advantageous if the gas feed pipe projecting into the melt features a spherical segment, truncated cone or truncated pyramid-shaped outer contour at least in the region of the gas outlet end. In this context, it is advantageous for the outer contour of the gas feed pipe to be of a design where the angle which the generatrix of the truncated surface forms with the axis of the gas inlet channel is less than about 60°, preferably less than about 45°.

In terms of industrial engineering, but also with regard to the output of the plant and the product quality, it may also be of substantial advantage if at least 2, preferably more than 2 gas feed pipes, in particular each with the same mutual spacing and preferably of a value that is more than about 10 times the projection length of the outlet opening or the gas feed pipe, respectively, into the melt, are arranged in an exchangeable nozzle connection inside the melting crucible of metal foam installations. It is thus possible to make available a large amount of high-quality foam within short time periods, which may possibly be desirable in, e.g., a prematerial-intensive further processing, particularly of large parts.

Although excellent results in individual tests and in short-run production regarding a uniformity of the gas bubble volumes are obtained with a device of the type mentioned above, in tests regarding the feasibility of the provision of metal foam for a large-scale production of components and composite parts for the automotive industry, it has been determined that during a continuous operation the geometry of the device may change as a result of melt corrosion or reaction of the device with the melt. Thereby stable gas bubble separation criteria in continuous operation may no longer be achievable.

The present invention also provides a device with which stable gas bubble separation criteria during the foaming of a metal melt can be achieved also in continuous operation over extended periods of time. In this device, the gas feed pipe comprises a ceramic material at least in the region of the end thereof that is to come into contact with the metal melt.

An advantage of this embodiment of the device according to the invention is that the geometry of the same essentially remains unchanged even during prolonged contact with a metal melt of at least several hundred degrees Celsius, thereby making possible stable gas bubble separation criteria in the foaming of metal melts even if the device is used frequently and over extended periods of time. The high shape stability and long service life of the device according to the invention when in contact with melts makes it possible to provide metal foams of uniformly high quality in continuous operation without repair or exchange of the device. In comparison with steel devices previously used the parts of the device that are made of ceramics, optionally the entire device, react significantly more slowly with metal melts and thereby additionally render possible with the same geometry the development of a hydrophobic system with respect to a gas bubble development during the feeding of gas into the melt.

A particularly high reactive inertia and thus excellent use properties are achieved with a device according to the invention if the ceramic material comprises an oxide ceramic, in particular an aluminum oxide ceramic.

The process for producing a metal foam provided by the present invention results in a high quality metal foam by controlling the uniformity of the diameter or the size, respectively, of the respective individual bubbles and the size of the gas bubbles by a geometric nozzle design and by an adjustment of the inflow parameters of the gas into the metal melt.

The advantages of the produced metal foam include the fact that bubbles of essentially the same size substantially improve the supporting criteria of the metallic boundaries during mechanical stress with regard to a low specific gravity of the foam part and the desired material behavior thereof.

When metal foam parts with various diameters of bubbles of the respective same size are required in view of their intended use, according to the invention it is possible in a simple way to achieve the uniformity of the size of the individual bubbles by means of the projection of the gas feed pipe into the melt, and to control the size of the individual bubbles by the size of the gas outlet cross section, the size of the feed pipe face area and the level of the gas pressure. Namely, if any two metal foam parts incorporate gas bubbles of identical volume but of different size, their material behavior is also different during deformation, as a result of which a most suitable article can be produced for specific purposes.

Extensive tests have shown that the uniformity of the gas bubble size can be further increased if the gas is fed into the melt at a pressure which oscillates or alternates about an average value and/or through nozzles that are moved in an oscillating manner.

In process-related terms, but also with regard to a high product quality, it may further be advantageous if the gas is blown into the foaming metal at a pressure of about 0.3 to about 12 bar, preferably about 0.7 to about 5 bar.

Metal foam parts which are particularly light or of particularly low density can be produced if the metal melt is made of light metal, preferably aluminum or an aluminum alloy. A required versatile material behavior can thus be achieved at a low mass of the part.

The foamability of the metal, as well as the development of the foam matrix or the foam wall can be substantially improved if particles such as, e.g., SiC particles and/or $Al_2O_3$ particles as well as other nonmetallic particles and/or particles of intermetallic phases are used to make the foamable metal melts. With regard to the stability and strength, in particular the buckling strength of the foam walls, it is advantageous if particles for stabilizing the metal foam which have a size of about 1 to about 50 μm, preferably about 3 to about 20 μm are used and uniformly distributed in the foam matrix.

Particularly good results can be obtained if the particle content of the metal portion of the metal foam is about 2 to about 50 percent by volume, in particular about 18 to about 28 percent by volume.

It was found that while conducting a continuous foaming operation according to the above-mentioned process a bursting of bubbles with particles and metal adhered thereto which are located above the surface of the melt may take place to a slight extent, particularly in the case of a low particle content of the melt. As a result thereof, bubbles may combine in the flowable metal foam, so that the solidified metal foam may exhibit pores which are formed of two or more individual bubbles. These pores may become the starting points of a material failure during application of mechanical stress, in particular during application of a high punctual pressure.

In one aspect of the process of the present invention such a partial bursting of bubbles is prevented to the greatest possible extent, by blowing in the gas beneath the surface of the melt at least at a distance S (in millimeters) according to $$S=-11.5+144.6\times P^{-0.55}$$

wherein P is the numerical value of the particle content of the melt in percent by volume.

The advantages associated with this embodiment of the present process lie above all in the fact that by the provision of a minimum rising height according to the invention, the gas bubbles fed into the metal melt to be foamed will travel a minimum distance within the particle-containing melt when rising to the surface of the melt, and on their way sufficient particles can be accumulated on the surfaces of the gas bubbles to stabilize the bubbles against bursting once they have traversed the melt surface. In particular, according to the present invention foamable metal melts with low particle content, e.g., of about 2 percent by volume, can in a simple way be converted into stable metal foams of high quality by setting the value of the rising height of the gas bubbles as a function of the particle content of the metal melt.

A further improvement can be achieved if an oxygen-containing gas, such as, e.g., air, in particular, essentially pure oxygen, is blown into the melt. Thereby the advantageous effects of a gas bubble minimum rising height adjusted to the particle content of the melt can be increased in a surprising manner, because at the same time an oxide layer with a reinforcing effect develops on the surface of the gas bubble which has particles and metal adhering thereto.

To provide prematerial for producing metal foam articles with desired material behavior, the invention also provides a flowable metal foam with gas bubbles which are defined by walls of a liquid metal matrix with solid reinforcing particles embedded therein, and wherein the value of the diameter of the largest gas bubbles divided by that of the smallest gas bubbles is less than 2.5. When various means are used, such a flowable metal foam can be shaped into parts and allowed to solidify with a high degree of precision, where depending on the individual bubble size and ratio a certain density of the part and its upsetting behavior can be achieved when it is subjected to compressive strain. Foam parts with a density of about 0.09 to about 0.11 $gcm^{-3}$ undergo, e.g., upsetting degrees of up to about 70% at only slightly rising compressive strains of 0.25 to 0.8 MPa.

A metal foam part that withstands both high areal as well as high punctual mechanical stress is achieved if the pores in a metal foam of the type mentioned at the outset are formed essentially closed with a spherical and/or ellipsoid shape, the respectively largest diameters of the pores show a monomodal distribution and the pores are formed essentially of individual stabilized bubbles, and if the wall inner surfaces are at least partially coated with an oxide.

With a monomodal size distribution of spatially uniformly distributed pores which is favorable in terms of the isotropy of mechanical properties, a metal foam part according to the invention additionally features an oxide-reinforced pore wall structure, whereby an increased loading capacity in use can be obtained or the service life of components comprising a corresponding metal foam unit can be increased. If the pores of a foam part essentially correspond to individual stabilized bubbles of the corresponding flowable metal foam, the metal foam part according to the invention is suitable for use in components not only in the case of high areal strain but in an excellent manner also in the case of high strain that is applied punctually.

A preferred embodiment of the metal foam part of the present invention is described in a concurrently filed U.S. application in the names of Franz Dobesberger, Herbert Flankl, Dietmar Leitlmeier, Alois Birgmann, and Peter Schulz and having the title "Process For Producing A Lightweight Molded Part And Molded Part Made Of Metal Foam", the disclosure of which is expressly incorporated herein by reference in its entirety.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
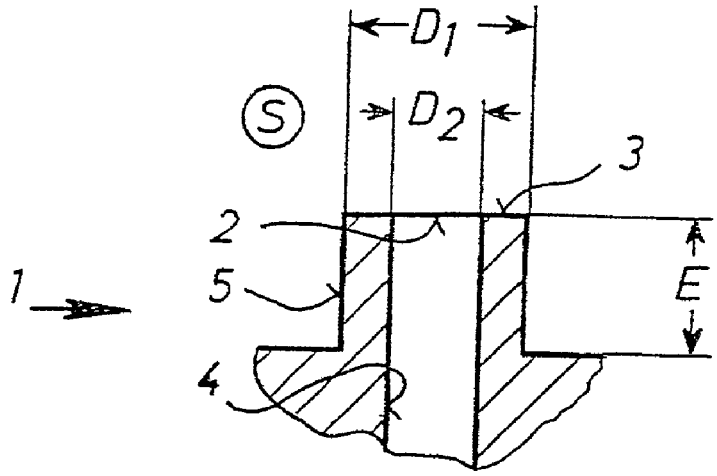
FIG. 1 shows a gas feed pipe.

FIG. 1 shows a gas feed pipe 1 that projects into a melt with a projection length E. Between its inner surface 4 and its outer surface 5 the gas feed pipe 1 shows a constant wall thickness. The pipe face surface 3 projects into the melt S.

Figure 2:
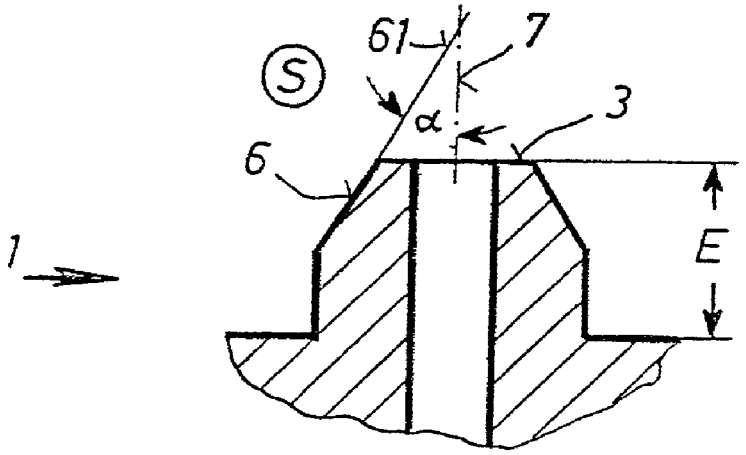
FIG. 2 shows a gas feed pipe with truncated cone-shaped outer contour.

FIG. 2 shows a gas feed pipe 1 with a projection length E into a melt S, which pipe 11 has a truncated cone- or truncated pyramid-shaped outer contour 6 in the outlet area, which outer contour in its extension forms an angle with the axis 7 of a gas intake channel. With such an embodiment of a gas feed pipe 1, a pipe face surface 3 with the lowest surface content can be formed up to a face edge with high stability and strength of the base part.

Figure 3:
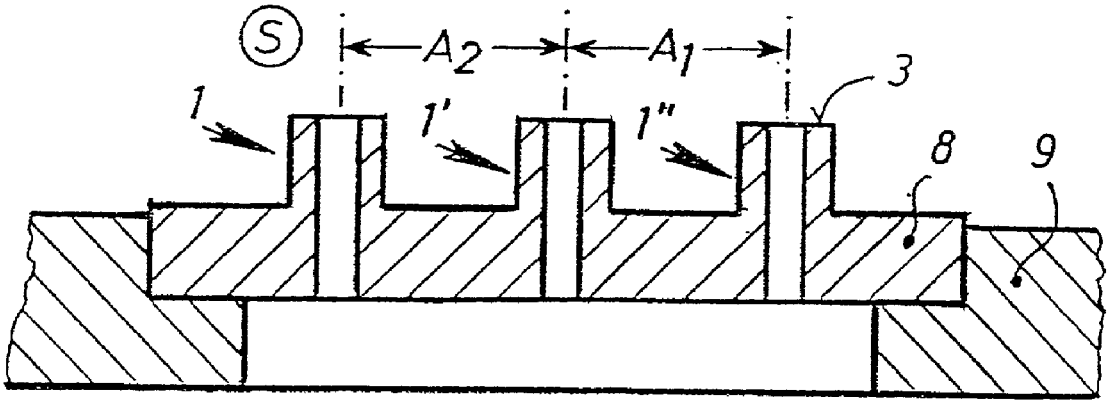
FIG. 3 shows a nozzle connection with several gas feed pipes.

FIG. 3 shows an embodiment with a nozzle connection 8 that is arranged in a wall 9 of a melting crucible in a preferably detachable manner. Three gas feed pipes 1, 1', 1" are arranged in the nozzle connection 8, projecting into a melt S at a distance $A_1$ and $A_2$ from one another. Such easily exchangeable nozzle connections 8 are preferably used when metal foams with essentially identical individual bubble volume, but with different bubble sizes are to be produced, because the development criteria size of the gas outlet cross section and size of the gas feed pipe face area can thus be changed within a short period of time.

The bubble formation mechanisms will briefly be explained again on the basis of the schematic drawings.

When gas is fed into a melt S, a convex vaulting is formed therein at the outlet opening 2 of the feed pipe 1. The melt hangs on the circumferential area of the gas outlet opening around this enlarging vaulting. Because the melt/wall boundary surface system is present as a hydrophobic system, the adhesive strength of the liquid metal round about the gas outlet opening is low, which leads to separation phenomena and areal migration of the gas bubble boundary at the wall. As a result thereof, the separation conditions for the gas bubble are largely indefinite, which may afford widely differing bubble sizes. If bubbles are to be produced by means of several adjacent outlet openings, in most cases they combine, as a result of which a desired foaming is prevented or an irregular bubble structure of the metal foam is formed.

If, for example, a gas feed pipe 1 projecting into the metal melt has an inner diameter D2 and a gas outlet cross section 2 and an outer diameter D1, this results in the size of the pipe face surface 3.

However, when gas is introduced into the melt the gas bubble boundary can migrate only up to the outer edge of the pipe face surface 3, whereby a substantial influence on the separation criteria is provided. Adjacent gas feed pipes 1, 1', 1" that project into a foamable melt S also develop defined separation criteria for gas bubbles because of the areas offset at the outer edges of the face surfaces 3, so that a combination of individual bubbles and a formation of large bubbles are largely prevented.

In extensive series of tests various particle-containing aluminum alloys, e.g., AlSi7Mg, an aluminum alloy also known as A 356 which in addition to aluminum essentially contains 7% by weight silicon and 1% by weight magnesium, or, e.g., AA 6061 (aluminum alloy with a composition according to standard Aluminium Association Number 6061) were melted in a crucible. An adjustment of the particle content of the melt was made, if necessary, by the addition of a particle-free alloy of appropriate chemical composition. Subsequently, gas was fed into the particle-containing melts. In each case the feed was made in all tests via a single nozzle body with an outlet opening, using nozzle bodies made of chrome-nickel steel and of ceramic material, respectively.

The durability of different nozzle bodies was examined in a first series of tests. When conducting five foaming tests each over periods of 20 seconds to 45 minutes with chrome-nickel steel nozzles on the one hand and with aluminum oxide nozzles on the other hand, a change in the shape of the gas outlet opening due to melt corrosion could be optically determined for the steel nozzles that were in use for longer than 2 minutes. In conformity therewith, the metal foams produced at the start and at the end of the foaming process and removed from the melt surface exhibited varying pore diameters. In contrast, no such changes in the geometry were visible in the case of the nozzle bodies made of aluminum oxide, even during a continuous use fore more than 45 minutes. Accordingly, it was possible to produce metal foam with consistent pore properties over the entire period of the test. Other ceramic materials, such as $SiO_2$ or $SiO_2/Al_2O_3$ could also be used advantageously compared with steels; however, the longest relative service life was obtained with nozzle bodies of $Al_2O_3$.

Figure 4:
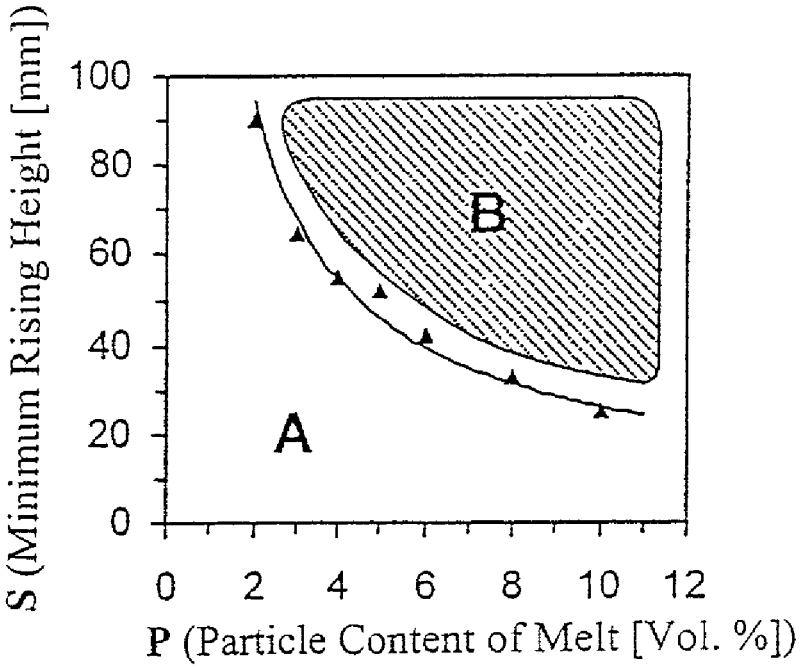
FIG. 4 is a diagram showing the relationship between of the minimum rising height provided according to the invention and the particle content of the melt.

In a second series of tests with nozzle bodies of aluminum oxide and a fixed particle content P the rising height S of the gas fed was varied and the quality of metal foams formed at various gas feeding depths was tested. The following behavior was observed, as shown with reference to FIG. 4: a cross-sectional view of metal foam formed with low particle content P of the melt, e.g., 2% by volume, and a low rising height S, shows pores that are formed by at least two bubbles. Such bubbles can be simply recognized by the fact that they show an ellipsoid elongated form with a high ratio of the longer axis to shorter axis. Such a behavior was found with the tested particle contents in the rising height region A of FIG. 4. However, as soon as the rising height S at a given particle content P is no longer in the region A of FIG. 4, but is increased such that it is within region B, a metal foam can be produced in which, due to the increased rising height, the bubbles can accumulate enough particles on their surfaces to be stabilized against a bursting in the liquid metal foam. The necessary rising heights for essentially complete bubble stabilization determined in experiments are shown for different particle contents in FIG. 4 in the form of triangles. The line that separates region A from region B represents a fitting curve of the general formula $$Y=a+X^b$$

that is adjusted to the experimental data.

Figure 5:
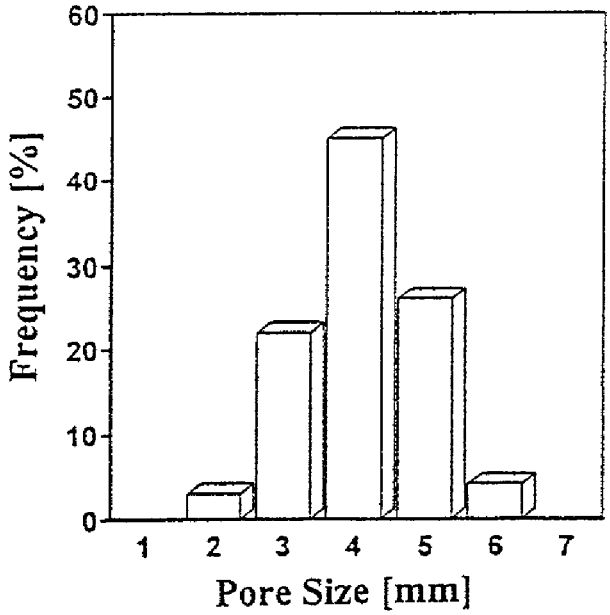
FIG. 5 is a diagram showing the pore size distribution of a metal foam part according to the invention.

It was determined in cross-sectional view that when the minimum rising height was maintained, more than about 95%, sometimes more than about 99%, of the pores in the metal foam corresponded to individual gas bubbles. FIG. 5 shows the pore size distribution of a metal foam that was produced while maintaining the foaming conditions according to the invention. As can be seen from the diagram of FIG. 5, with a monomodal distribution of pore sizes and an average value of about 4 nun, the proportion of pores of a size of about 6 mm is proportionately only slightly higher than that of pores of a size of 2 mm, i.e., the pore sizes are distributed on both sides of a mean value to almost the same extent or with the same frequency.

In a third series of tests, the effects of the blown in gas on the composition and the properties of the resulting materials were studied. Secondary electron microscope (SEM) photographs surprisingly showed that when oxygen-containing gas, such as cost-effective air, is used, an additional layer of an oxide is formed on the pore surfaces in partial regions. The oxide layer has a reinforcing effect on the metal foam, as shown by an about 5 to 7% increase in the deformation energy that was necessary to compress metal foam parts according to the invention to 50% of the original volume. A further increase of this deformation energy by a total of about 10% was observed when pure oxygen was used as foaming gas. In such cases, it also was possible to show by means of SEM photographs that the wall inner surfaces were coated essentially completely, i.e., at least 90%, with an oxide layer.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A device for blowing gas into a foamable metal melt and comprising at least one gas feeding pipe that projects into the metal melt, said feeding pipe having a gas outlet end with a gas outlet opening and a pipe face, wherein the gas outlet opening has a cross section of from 0.006 to 0.2 $mm^2$ and the pipe face has an area of less than 4.0 $mm^2$ and wherein at least the gas outlet end of the gas feeding pipe comprises a ceramic material.

2. The device of claim 1, wherein the gas outlet opening is of circular shape.

3. The device of claim 2, wherein the pipe face has a circular ring shape and surrounds the gas outlet opening.

4. The device of claim 2, wherein the feeding pipe projects into the metal melt by at least five times the largest dimension of the gas outlet opening.

5. The device of claim 3, wherein the feeding pipe projects into the metal melt by at least ten times the diameter of the gas outlet opening.

6. The device of claim 1, wherein the gas outlet end of the gas feeding pipe has an outer contour selected from spherical segment, truncated cone and truncated pyramid shapes.

7. The device of claim 6, wherein a generatrix of a truncated surface and a longitudinal axis of the feeding pipe intersect at an angle of less than 60°.

8. The device of claim 7, wherein said angle is smaller than 45°.

9. The device of claim 1, wherein said device comprises at least two gas feeding pipes.

10. The device of claim 1, wherein said device comprises more than two gas feeding pipes.

11. The device of claim 10, wherein a distance between any two adjacent pipes is greater than 10 times a length by which the feeding pipes project into the metal melt.

12. The device of claim 10, wherein the device further comprises a melting crucible and said at least two feeding pipes are part of an exchangeable nozzle connection arranged inside said melting crucible.

13. The device of claim 1, wherein said ceramic material comprises aluminum oxide.

14. The device of claim 1, wherein the gas outlet opening is of circular shape and the pipe face is of circular ring shape, the feeding pipe projects into the metal melt by at least ten times the diameter of the gas outlet opening, the gas outlet end of the gas feeding pipe has an outer contour selected from spherical segment, truncated cone and truncated pyramid shapes, and at least the gas outlet end of the gas feeding pipe is made of an aluminum oxide ceramic material.

15. The device of claim 14, wherein the device comprises more than two gas feeding pipes and a distance between any two adjacent pipes is greater than 10 times a length by which the feeding pipes project into the metal melt.

16. A process for producing a foamed metal melt by blowing gas into a metal melt, wherein gas is blown into a foamable metal melt by the device of claim 1.

17. A process for producing a foamed metal melt by blowing gas into a metal melt, wherein gas is blown into a foamable metal melt by the device of claim 14.

18. A process for producing a foamed metal melt by blowing gas into a metal melt through at least one gas outlet, wherein a size of individual gas bubbles and a size uniformity thereof is controlled by a geometric design of the gas outlet and by adjusting gas inflow parameters and wherein the gas is blown into the metal melt at a minimum distance S in mm from a surface of the melt according to the equation:

$$S=-11.5+144.6\times P^{-0.55}$$

wherein P is the numerical value of a particle concentration of the melt in vol. %.

19. The process of claim 18, wherein said gas outlet is part of a gas feeding pipe which projects into the metal melt and comprises a gas outlet opening and a pipe face and wherein the geometric design of the gas outlet comprises a cross section of the gas outlet opening and an area of the pipe face.

20. The process of claim 19, wherein the gas outlet opening has a cross section of from 0.006 to 0.2 $mm^2$ and the pipe face has an area of less than 4.0 $mm^2$.

21. The process of claim 20, wherein the gas outlet opening is of a circular shape and the pipe face is of a circular ring shape and surrounds the gas outlet opening.

22. The process of claim 20, wherein the gas feeding pipe projects into the metal melt by at least five times the largest dimension of the gas outlet opening.

23. The process of claim 21, wherein the gas feeding pipe projects into the metal melt by at least ten times the diameter of the gas outlet opening.

24. The process of claim 18, wherein the gas inflow parameters comprise a pressure under which the gas is blown into the metal melt.

25. The process of claim 24, wherein the gas is blown into the metal melt under a pressure which at least one of oscillates and alternates about a mean value.

26. The process of claim 25, wherein the gas outlet is moved in an oscillating manner.

27. The process of claim 20, wherein the gas is blown in under a pressure of from 0.3 to 12 bar.

28. The process of claim 18, wherein the gas is blown in under a pressure of from 0.7 to 5 bar.

29. The process of claim 18, wherein the metal comprises a light metal.

30. The process of claim 29, wherein the light metal comprises at least one of aluminum and alloys thereof.

31. The process of claim 18, wherein the metal melt comprises solid particles.

32. The process of claim 31, wherein said particles are selected from nonmetallic and intermetallic particles.

33. The process of claim 32, wherein the said nonmetallic particles are selected from SiC particles, $Al_2O_3$ particles and combinations thereof.

34. The process of claim 33, wherein the particles have a size of from 1 to 50 μm.

35. The process of claim 31, wherein the particles have a size of from 3 to 20 μm.

36. The process of claim 18, wherein the metal melt comprises solid particles in a concentration of from 2 to 50 vol. %.

37. The process of claim 35, wherein the metal melt comprises the solid particles in a concentration of from 18 to 28 vol. %.

38. The process of claim 19, wherein said gas comprises oxygen.

39. The process of claim 29, wherein said gas is air.

40. The process of claim 18, wherein said gas is essentially pure oxygen.

41. The process of claim 19, wherein the gas outlet opening has a cross section of from 0.006 to 0.2 $mm^2$ and the pipe face has an area of less than 4.0 $mm^2$, the gas is blown in under a pressure of from 0.7 to 5 bar, the metal comprises at least one of aluminum and alloys thereof, the metal melt comprises solid particles having a size of from 3 to 20 μm and selected from SiC particles, $Al_2O_3$ particles and combinations thereof in a concentration of from 18 to 28 vol. %, and said gas comprises oxygen.

42. A foamed metal melt comprising a metal melt having gas bubbles therein, wherein a diameter of a largest bubble of said gas bubbles is less than 2.5 times a diameter of a smallest bubble of said gas bubbles.

43. A metal foam part made from the foamed metal melt of claim 42.

44. A metal foam part comprising a metal matrix with pores evenly distributed therein, wherein the metal matrix has solid particles embedded therein, the pores are closed and have at least one of an essentially spherical and an essentially ellipsoid shape, respectively largest dimensions of said pores show a monomodal distribution, and inner wall surfaces of said pores comprise at least in part oxidized metal matrix.

* * * * *